US011352908B1

(12) United States Patent
Mizumi et al.

(10) Patent No.: US 11,352,908 B1
(45) Date of Patent: Jun. 7, 2022

(54) TURBINE STATOR BLADE AND STEAM TURBINE

(71) Applicant: Mitsubishi Power, Ltd., Kanagawa (JP)

(72) Inventors: Shunsuke Mizumi, Tokyo (JP); Chongfei Duan, Tokyo (JP); Yasuhiro Sasao, Yokohama (JP); Soichiro Tabata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/433,037

(22) PCT Filed: Feb. 26, 2020

(86) PCT No.: PCT/JP2020/007666
§ 371 (c)(1),
(2) Date: Aug. 23, 2021

(87) PCT Pub. No.: WO2020/175533
PCT Pub. Date: Sep. 3, 2020

(30) Foreign Application Priority Data

Feb. 27, 2019 (JP) ..... JP2019-033540

(51) Int. Cl.
*F01D 25/32* (2006.01)
*F01D 9/04* (2006.01)
*F01D 5/14* (2006.01)

(52) U.S. Cl.
CPC ..... *F01D 25/32* (2013.01); *F01D 5/141* (2013.01); *F01D 5/147* (2013.01); *F01D 9/041* (2013.01); *F05D 2240/122* (2013.01)

(58) Field of Classification Search
CPC ..... F01D 9/041; F01D 5/141; F01D 5/147; F01D 25/32; F05D 2240/122
See application file for complete search history.

(56) References Cited

U.S. PATENT DOCUMENTS 1,829,674 A * 10/1931 Rosenlocher ..... F01D 25/32 96/217
8,132,414 B2 * 3/2012 Niizeki ..... F01D 5/288 416/241 A (Continued)

FOREIGN PATENT DOCUMENTS

CN 103670532 A 3/2014
CN 103670532 B 12/2016

(Continued)

OTHER PUBLICATIONS

International Search Report dated May 12, 2020 in corresponding International Application No. PCT/JP2020/007666, with English translation.

(Continued)

*Primary Examiner* — Michael Lebentritt
*Assistant Examiner* — Brian Christopher Delrue
(74) *Attorney, Agent, or Firm* — Wenderoth, Lind & Ponack, L.L.P.

(57) ABSTRACT

A turbine stator blade (21) includes a pressure side (21P) extending in a radial direction intersecting a flowing direction of steam and facing upstream in the flowing direction. A slit (5) capturing droplets generated by liquefaction of the steam is formed on a downstream side of the pressure side (21P). A fine uneven region (6), which guides the droplets attached to the pressure side (21P) in the radial direction such that the droplets are moved toward the slit (5) and from upstream toward downstream, is formed in a further upstream position than the slit (5). The fine uneven region (6) has a flow resistance to the droplets gradually increasing from inward to outward in the radial direction.

9 Claims, 5 Drawing Sheets

(56) References Cited

U.S. PATENT DOCUMENTS

| | | | | |
|---|---|---|---|---|
| 9,598,964 | B2 * | 3/2017 | Ishibashi | F01D 5/145 |
| 10,132,178 | B2 * | 11/2018 | Ishibashi | F01D 25/32 |
| 10,781,722 | B2 * | 9/2020 | Fandrei, II | B23K 26/0624 |
| 10,794,196 | B2 * | 10/2020 | Nakano | F01D 5/28 |
| 11,174,746 | B2 * | 11/2021 | Taniguchi | F01D 5/08 |
| 2007/0014670 | A1 * | 1/2007 | Maeno | B23P 15/04 416/232 |
| 2007/0101719 | A1 * | 5/2007 | Niizeki | F01D 5/288 60/645 |
| 2014/0030065 | A1 * | 1/2014 | Nakano | F01D 5/28 415/115 |
| 2014/0079556 | A1 | 3/2014 | Ishibashi et al. | |
| 2017/0167301 | A1 * | 6/2017 | Fandrei, II | B23K 26/60 |

FOREIGN PATENT DOCUMENTS

| | | | | |
|---|---|---|---|---|
| EP | 2692990 | A2 * | 2/2014 | F01D 25/32 |
| JP | 2013-155725 | | 8/2013 | |
| JP | 2017-020443 | | 1/2017 | |
| JP | 2017-106451 | | 6/2017 | |
| WO | 2012/131905 | | 10/2012 | |
| WO | WO-2020175192 | A1 * | 9/2020 | |
| WO | WO-2020175533 | A1 * | 9/2020 | |
| WO | WO-2020250596 | A1 * | 12/2020 | |
| WO | WO-2021117883 | A1 * | 6/2021 | |

OTHER PUBLICATIONS

Written Opinion of the International Searching Authority dated May 12, 2020 in corresponding International Application No. PCT/JP2020/007666, with English translation.

Reiner Fürstner et al., "Wetting and Self-Cleaning Properties of Artificial Superhydrophobic Surfaces", Langmuir, 2005, 21, pp. 956-961.

Andreas Solga, et al., "The dream of staying clean: Lotus and biomimetic surfaces", Bioinspiration & Biomimetics, 2007, vol. 2 No. 4, pp. S126-S134.

* cited by examiner

TURBINE STATOR BLADE AND STEAM TURBINE

TECHNICAL FIELD

The present invention relates to a turbine stator blade and a steam turbine.

This application claims priority based on Japanese Patent Application No. 2019-033540, filed Feb. 27, 2019, the content of which is incorporated herein by reference.

BACKGROUND ART

A steam turbine includes a rotary shaft that is rotatable around an axis, a plurality of turbine rotor blade stages that are arranged in a direction of the axis on an outer circumferential surface of the rotary shaft with a gap therebetween, a casing that covers the rotary shaft and the turbine rotor blade stages from an outer circumferential side, and a plurality of turbine stator blade stages that are alternately arranged with the turbine rotor blade stages on an inner circumferential surface of the casing. An intake port for taking in steam from outside is formed on an upstream side of the casing, and an exhaust port is formed on a downstream side of the casing. A flowing direction and a speed of high-temperature/high-pressure steam taken in through the intake port are adjusted in the turbine stator blade stages, and then the steam is converted into a rotational force of the rotary shaft in turbine rotor blade stages.

Steam which has passed through inside of the turbine loses its energy from upstream toward downstream, and thus the temperature (and the pressure) thereof decreases. Therefore, in the turbine stator blade stage on the most downstream side, part of the steam is liquefied and is present in an air flow as fine water droplets. Part of the water droplets are attached to an outer surface of the turbine stator blade. The water droplets grow into a liquid film immediately on the blade surface. The liquid film are exposed to a fast steam flow around the liquid film at all times. However, when this liquid film further grows and increases in thickness, part thereof is split due to a steam flow and scatters in a state of huge droplets. Scattered droplets flow to the downstream side on a mainstream while gradually accelerating due to a steam flow. The larger the sizes of droplets, the greater the inertial forces acting on themselves. Thus, the droplets cannot pass through spaces between the turbine rotor blades on the mainstream steam and collide with the turbine rotor blades. Since the peripheral speed of the turbine rotor blade may exceed the speed of sound, when scattered droplets collide with the turbine rotor blades, the outer surfaces thereof may be eroded and erosion may occur. In addition, rotation of the turbine rotor blades may be hindered due to collisions of droplets, thereby resulting in braking loss.

In order to prevent such adhesion and growth of droplets, various technologies have been proposed so far. For example, in the device described in the following Patent Literature 1, an extraction port for suctioning a liquid film is formed on an outer surface of a turbine stator blade, and a hydrophilic removal surface expanding from a leading edge of the turbine stator blade toward this extraction port is formed. After a liquid film has moved along the removal surface, it can be sucked through the extraction port.

CITATION LIST

Patent Literature

[Patent Literature 1]

Japanese Unexamined Patent Application, First Publication No. 2017-106451

SUMMARY OF INVENTION

Technical Problem

However, in the device described in the foregoing Patent Literature 1, a removal surface is merely uniformly formed toward an extraction port. Namely, the removal surface has constant hydrophilicity therein. In addition, there is no description regarding a flow resistance to a liquid film on a processed surface, and control of a liquid film using a difference between the flow resistances is not taken into consideration. For this reason, a force toward a slit does not necessarily act on droplets which have arrived at the removal surface. As a result, there is a possibility that droplets will flow outside from the removal surface. That is, there is still room for improvement in the device described in the foregoing Patent Literature 1.

The present invention has been made in order to resolve the foregoing problems, and an object thereof is to provide a turbine stator blade capable of more efficiently collecting droplets and a steam turbine including the same.

Solution to Problem

A turbine stator blade according to an aspect of the present invention includes a pressure side extending in a radial direction intersecting a flowing direction of steam and facing upstream in the flowing direction. A slit capturing droplets generated by liquefaction of the steam is formed on a downstream side of the pressure side. A fine uneven region, which guides the droplets attached to the pressure side in the radial direction such that the droplets are moved toward the slit and from upstream toward downstream, is formed in a further upstream position than the slit. The fine uneven region has a flow resistance to the droplets gradually increasing from inward to outward in the radial direction.

According to the foregoing constitution, the flow resistance to droplets gradually increases from inward to outward in the radial direction in the fine uneven region. The higher the flow resistance to droplets is, the slower the flow rate of the droplets is. Namely, in droplets straddling two regions having different flow resistances, a speed component from the region having the lower flow resistance toward the region having the higher flow resistance is generated. Therefore, when the flow resistance increases from inward to outward in the radial direction as described above, droplets flow such that they are guided toward the slit based on a flow of steam and a difference between the foregoing flow resistances. As a result, droplets positioned at a central portion on the pressure side in the radial direction are guided to the fine uneven region so that the droplets flow in the radial direction and then are captured by the slit. Accordingly, it is possible to reduce a possibility that split droplets will scatter downstream of the turbine stator blade and collide with a turbine rotor blade.

In the foregoing turbine stator blade, the fine uneven region may include a plurality of hydrophilic regions which are provided to be adjacent to each other in the radial direction, flow resistances to the droplets of the plurality of hydrophilic regions may be different from each other between the plurality of regions, and the further outward the hydrophilic region is positioned in the radial direction, the higher the flow resistance of the hydrophilic region may be.

According to the foregoing constitution, the fine uneven region has a plurality of hydrophilic regions which are provided to be adjacent to each other in the radial direction. Therefore, droplets or liquid films spread more thinly based on the hydrophilicity of a wall surface. Accordingly, droplets or liquid films are likely to straddle between the foregoing plurality of regions. Therefore, in droplets or liquid films straddling two regions having different flow resistances, a speed component is generated from the region having the lower flow resistance toward the region having the higher flow resistance. As a result, droplets or liquid films positioned at a central portion on the pressure side in the radial direction are guided to the fine uneven region so that they flow toward the slit. Accordingly, it is possible to further reduce a possibility that droplets or liquid films will split and scatter downstream.

In the foregoing turbine stator blade, the fine uneven region may be gradually curved from upstream toward downstream to change from a state of extending in the flow direction toward a state of extending in the radial direction.

According to the foregoing constitution, the fine uneven region is gradually curved from upstream toward downstream to change from a state of extending in the flow direction toward a state of extending in the radial direction. Therefore, droplets flowing in the flowing direction can be more actively guided such that the droplets are moved in the radial direction. Accordingly, it is possible to further reduce a possibility that split droplets will scatter downstream in the flowing direction.

In the foregoing turbine stator blade, the fine uneven region may include hydrophilic regions and water-repellent regions which are alternately arranged in the radial direction.

According to the foregoing constitution, there is a difference between the flow resistances to droplets of the hydrophilic regions and the water-repellent regions. The higher the flow resistance to droplets is, the slower the flow rate of the droplets is. Namely, in droplets straddling two regions having different flow resistances, a speed component is generated from the region having the lower flow resistance toward the region having the higher flow resistance. Therefore, droplets flow such that they are guided toward the slit. As a result, droplets positioned at a central portion on the pressure side in the radial direction are guided to the fine uneven region so that they flow in the radial direction and then are captured by the slit. Accordingly, it is possible to reduce a possibility that split droplets will scatter on the downstream side of the turbine stator blade and collide with the turbine rotor blade.

In the foregoing turbine stator blade, the fine uneven region may include a hydrophilic region and a water-repellent region arranged in the radial direction and an unworked surface formed between the hydrophilic region and the water-repellent region.

According to the foregoing constitution, there is a difference between the flow resistances to droplets or liquid films of the hydrophilic regions, the regions on the unworked surface, and the water-repellent regions in this order. Generally, the more hydrophilic a wall surface is, the better the affinity between water and the wall surface becomes. Namely, forces of pulling each other between water and the wall surface become stronger. Consequently, the flow resistance increases. The higher the flow resistance to droplets or liquid films is, the slower the flow rate of the droplets is. Namely, in droplets straddling two regions having different flow resistances, a speed component is generated from the region having the lower flow resistance toward the region having the higher flow resistance. Therefore, droplets flow such that they are guided toward the slit. As a result, droplets positioned at a central portion on the pressure side in the radial direction are guided to the fine uneven region so that they flow in the radial direction and then are captured by the slit. Accordingly, it is possible to reduce a possibility that split droplets will scatter on the downstream side of the turbine stator blade and collide with the turbine rotor blade.

In the foregoing turbine stator blade, the fine uneven region may include a hydrophilic region and a water-repellent region arranged in the radial direction and an unworked surface formed between the hydrophilic region and the water-repellent region; and the hydrophilic region, the unworked surface and the water-repellent region may be arranged in this order and in a repeated form.

According to the foregoing constitution, the flow resistance increases from the water-repellent regions toward the hydrophilic regions. Basically, a liquid film flows along a flow of a surrounding air flow. However, if the flow resistances of portions of the wall surface differ from each other, a liquid film is curved to a portion where the flow resistance is high. Namely, a speed component is generated in a direction in which the flow resistance increases. Since a liquid film has a large inertial force because it is formed of liquid, the liquid film goes over the area of the highest flow resistance on a processed surface repeatedly arranged in the foregoing constitution and moves to the place of the next lower flow resistance, and this process is repeated. Therefore, droplets flow such that they are guided toward the slit. As a result, droplets positioned at a central portion on the pressure side in the radial direction are guided to the fine uneven region so that the droplets flow in the radial direction and then are captured by the slit. Accordingly, it is possible to reduce a possibility that split droplets will scatter downstream of the turbine stator blade and collide with the turbine rotor blade.

In the foregoing turbine stator blade, the slit may be provided to be apart from a trailing edge that is an end edge of the turbine stator blade on the downstream side with a gap therebetween in the flowing direction, and a super water-repellent region having higher water repellency than the pressure side may be formed in the gap.

According to the foregoing constitution, a super water-repellent region is formed in the gap between the slit and the trailing edge. Accordingly, for example, even when some droplets cannot be captured enough by the slit and flow away to the downstream side, they are repelled by the super water-repellent region. Therefore, it is possible to reduce a possibility that droplets will remain on the downstream side of the slit. As a result, it is possible to suppress a situation in which the remaining droplets gather and a larger liquid film is formed.

In the foregoing turbine stator blade, an inner fine uneven region guiding the droplets attached to the pressure side in the radial direction from upstream toward downstream may be further formed on an inner side in the radial direction of the fine uneven region of the pressure side. The inner fine uneven region may have a flow resistance to the droplets gradually increasing inward in the radial direction.

According to the foregoing constitution, the flow resistance to droplets gradually increases inward in the radial direction in the inner fine uneven region. The higher the flow resistance to droplets is, the slower the flow rate of the droplets is. Namely, in droplets straddling two regions having different flow resistances, a speed component is generated from the region having the lower flow resistance toward the region having the higher flow resistance. Therefore, when the flow resistance increases in the radial direction as described above, droplets flow such that they are guided from outward to inward in the radial direction. As a result, droplets positioned at a central portion on the pressure side in the radial direction are guided to the inner fine uneven region so that they flow inward in the radial direction. Since a peripheral speed of the turbine rotor blade positioned on the downstream side of the turbine stator blade is reduced inward in the radial direction, compared to a case in which droplets collide with a part positioned on the outside of the turbine rotor blade in the radial direction in which the peripheral speed is relatively high, it is possible to reduce a possibility that erosion or braking loss will occur.

A steam turbine according to another aspect of the present invention includes a rotary shaft rotatable around an axis, a plurality of turbine rotor blades arranged in a circumferential direction with respect to an axis direction on an outer circumferential surface of the rotary shaft, a casing covering the rotary shaft and the turbine rotor blades from an outer circumferential side, and a plurality of the turbine stator blades according to any one of the above aspects that are arranged in the circumferential direction around the axis on an inner circumferential surface of the casing and provided to be adjacent to the turbine rotor blades in the axis direction.

According to the foregoing constitution, it is possible to provide a steam turbine including a turbine stator blade capable of more efficiently collecting droplets.

Advantageous Effects of Invention

According to the present invention, it is possible to provide a turbine stator blade capable of more efficiently collecting droplets and a steam turbine including the same.

DESCRIPTION OF EMBODIMENTS

First Embodiment

Figure 1:
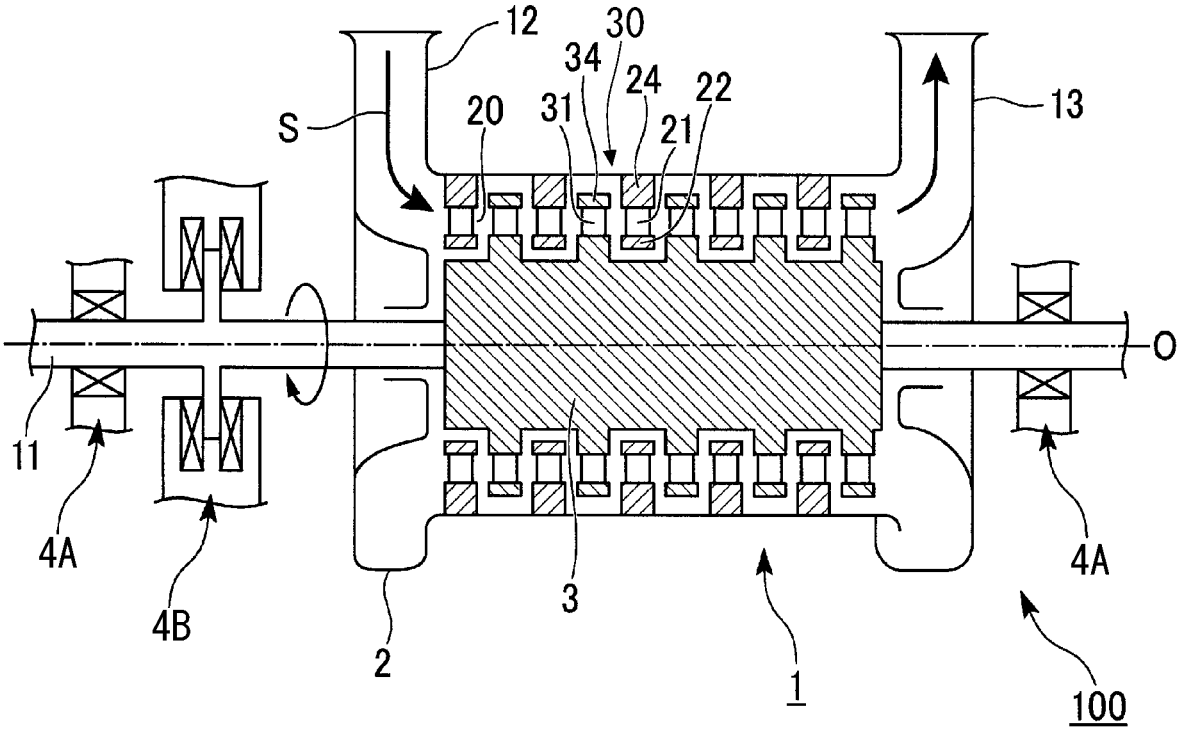
FIG. 1 is a schematic view illustrating a constitution of a steam turbine according to a first embodiment of the present invention.

A first embodiment of the present invention will be described with reference to FIGS. 1 to 4. A steam turbine 100 according to the present embodiment includes a steam turbine rotor 3 that extends in an axis O direction, a steam turbine casing 2 that covers the steam turbine rotor 3 from an outer circumferential side, and a journal bearing 4A and a thrust bearing 4B that support a shaft end 11 of the steam turbine rotor 3 such that it can rotate around the axis O.

The steam turbine rotor 3 has a rotary shaft 1 which extends along the axis O, and a plurality of rotor blades 30 which are provided on an outer circumferential surface of the rotary shaft 1. The plurality of rotor blades 30 are arranged in a circumferential direction of the rotary shaft 1 with a constant gap therebetween. Also in the axis O direction, the plurality of rotor blades 30 are arranged in a row with a constant gap therebetween. Each of the rotor blades 30 has a rotor blade main body 31 (turbine rotor blade) and a rotor blade shroud 34. The rotor blade main body 31 protrudes outward in a radial direction from an outer circumferential surface of the steam turbine rotor 3. The rotor blade main body 31 has a cross section having an airfoil shape when viewed in the radial direction. The rotor blade shroud 34 is provided at a distal end portion of the rotor blade main body 31 (an end portion on an outer side in the radial direction).

The steam turbine casing 2 substantially has a tubular shape covering the steam turbine rotor 3 from the outer circumferential side. A steam supply pipe 12 for taking in steam S is provided on one side of the steam turbine casing 2 in the axis O direction. A steam exhaust duct 13 for discharging the steam S is provided on the other side of the steam turbine casing 2 in the axis O direction. Steam flows inside the steam turbine casing 2 from the one side toward the other side in the axis O direction. In the following description, a flowing direction of steam will be simply referred to as "a flowing direction". Moreover, a side where the steam supply pipe 12 is positioned will be referred to as an upstream side in the flowing direction when viewed from the steam exhaust duct 13, and a side where the steam exhaust duct 13 is positioned will be referred to as a downstream side in the flowing direction when viewed from the steam supply pipe 12.

A row of a plurality of stator blades 20 is provided on an inner circumferential surface of the steam turbine casing 2. Each of the stator blades 20 has a stator blade main body 21 (turbine stator blade), a stator blade shroud 22, and a stator blade seat 24. The stator blade main body 21 is a member having an airfoil shape connected to the inner circumferential surface of the steam turbine casing 2 with the stator blade seat 24 therebetween. Moreover, the stator blade shroud 22 is provided at a distal end portion of the stator blade main body 21 (an end portion on an inner side in the radial direction). Similar to the rotor blades 30, the plurality of stator blades 20 are arranged in the circumferential direction and the axis O direction on the inner circumferential surface. The rotor blades 30 are disposed such that they each enter a region between the plurality of stator blades 20 adjacent to each other. Namely, the stator blades 20 and the rotor blades 30 extend in a direction intersecting the flowing direction of steam (the radial direction with respect to the axis O).

The steam S is supplied to inside of the steam turbine casing 2 constituted as described above via the steam supply pipe 12 on the upstream side. In the middle of passing through inside of the steam turbine casing 2, the steam S alternately passes through the stator blades 20 and the rotor blades 30. The stator blades 20 straighten a flow of the steam S, and a lump of the steam S that is a rectified fluid pushes the rotor blades 30 so as to apply a rotational force to the steam turbine rotor 3. A rotational force of the steam turbine rotor 3 is drawn out from the shaft end 11 and is used for driving external equipment (a generator or the like). In accordance with rotation of the steam turbine rotor 3, the steam S is discharged toward a subsequent device (a steam condenser or the like) through the steam exhaust duct 13 on the downstream side.

The journal bearing 4A supports a load in the radial direction with respect to the axis O. One journal bearing 4A is provided at each of both ends of the steam turbine rotor 3. The thrust bearing 4B supports a load in the axis O direction. The thrust bearing 4B is provided at only the end portion of the steam turbine rotor 3 on the upstream side.

Figure 2:
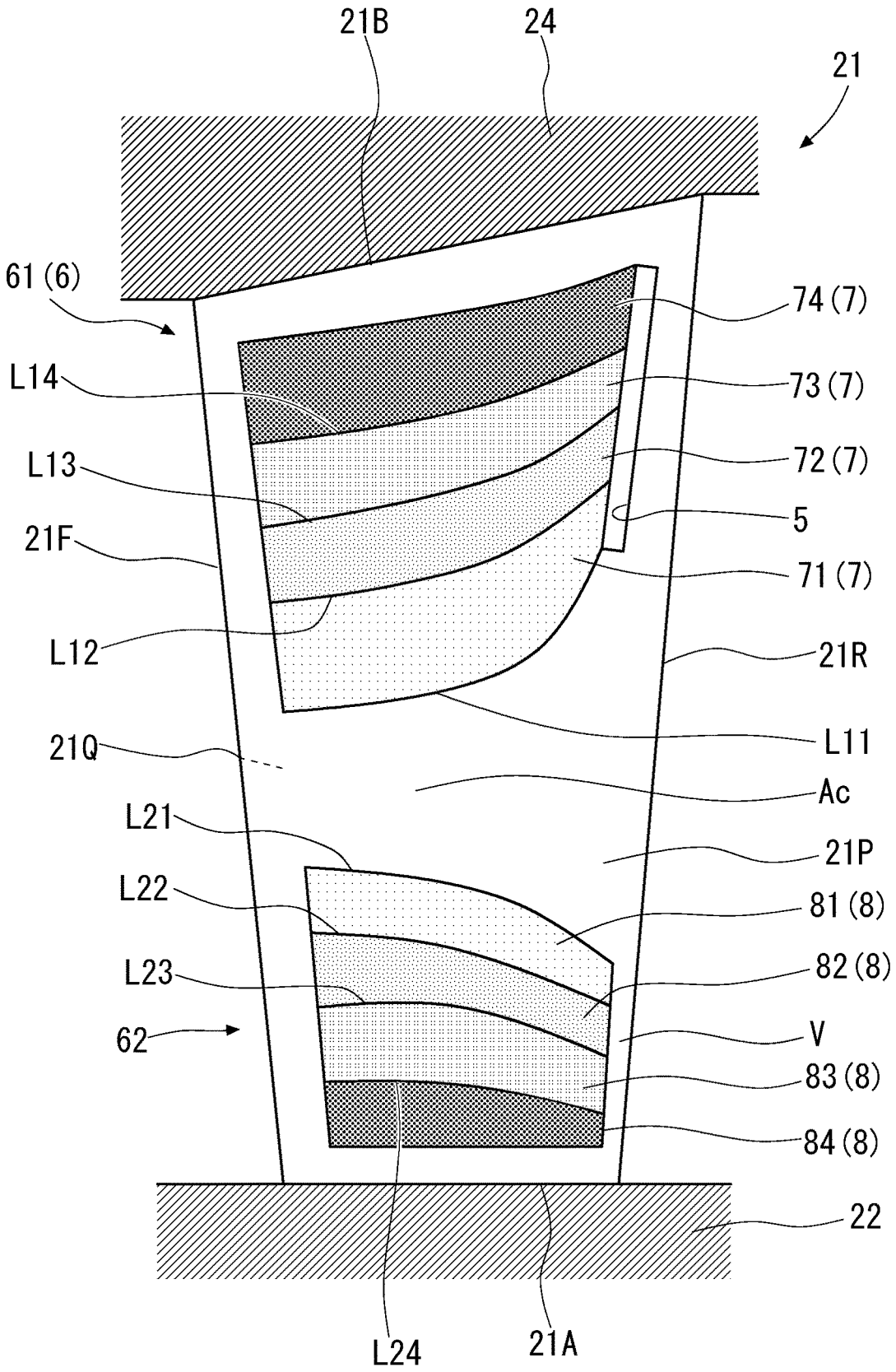
FIG. 2 is a perspective view illustrating a constitution of a turbine stator blade according to the first embodiment of the present invention.

Next, with reference to FIG. 2, a constitution of the stator blade main body 21 will be described. The stator blade main body 21 extends in the radial direction (the radial direction with respect to the axis O) which is a direction intersecting the flowing direction. When viewed in the radial direction, a cross section of the stator blade main body 21 has an airfoil shape. More specifically, a leading edge 21F that is an end edge on the upstream side in the flowing direction has a curved surface shape. A trailing edge 21R that is an end edge on the downstream side has a length gradually decreasing in the circumferential direction when viewed in the radial direction, thereby having a tapered shape. From the leading edge 21F to the trailing edge 21R, the stator blade main body 21 is gently curved from one side toward the other side in the circumferential direction with respect to the axis O.

A surface of the stator blade main body 21 on the one side in the circumferential direction serves as a suction side 21Q facing downstream in the flowing direction. The suction side 21Q has a curved surface shape projecting toward the one side in the circumferential direction. On the other hand, a surface of the stator blade main body 21 on the other side in the circumferential direction serves as a pressure side 21P facing upstream in the flowing direction. The pressure side 21P has a curved surface shape recessed toward the one side in the circumferential direction. In a state in which steam is flowing, a pressure on the pressure side 21P becomes higher than a pressure on the suction side 21Q.

An end surface of the stator blade main body 21 facing inward in the radial direction serves as an inner circumferential side end surface 21A, and an end surface thereof facing outward in the radial direction serves as an outer circumferential side end surface 21B. The inner circumferential side end surface 21A expands along the axis O described above. On the other hand, the outer circumferential side end surface 21B is inclined with respect to the axis O. Specifically, in a view of a cross section including the axis O, the outer circumferential side end surface 21B extends outward in the radial direction from upstream toward downstream along the axis O.

A slit 5, an outer fine uneven region 61 (fine uneven region 6), and an inner fine uneven region 62 are formed at a portion on the pressure side 21P close to the outer circumferential side end surface 21B (that is, a portion closer to the outer circumferential side end surface 21B than to the inner circumferential side end surface 21A). The slit 5 is a rectangular hole extending in a direction including a component of the radial direction on the pressure side 21P. More specifically, the slit 5 extends along the trailing edge 21R. The slit 5 is formed to capture liquefied components (droplets) of steam flowing from the leading edge 21F to the trailing edge 21R along the pressure side 21P. The slit 5 is connected to a flow channel (not illustrated) which is formed inside the stator blade main body 21, and captured droplets are sent to outside of the stator blade main body 21 through this flow channel.

The outer fine uneven region 61 is provided such that droplets attached to the pressure side 21P are guided in the radial direction toward the slit 5. The outer fine uneven region 61 is provided on an outer side in the radial direction of the pressure side 21P. Specifically, the outer fine uneven region 61 is provided at a position near the outer circumferential side end surface 21B. The outer fine uneven region 61 guides droplets attached to the pressure side 21P such that the droplets moving in the flowing direction are gradually moved outward in the radial direction.

The outer fine uneven region 61 is divided into a plurality of (four) regions (outer regions 7) in the radial direction. The outer region 7 on the most inner side in the radial direction serves as a first outer region 71. A second outer region 72 is adjacent to the first outer region 71 on an outer side thereof in the radial direction with a second outer boundary line L12 interposed therebetween. A third outer region 73 is adjacent to the second outer region 72 on an outer side thereof in the radial direction with a third outer boundary line L13 interposed therebetween. A fourth outer region 74 is adjacent to the third outer region 73 on an outer side thereof in the radial direction with a fourth outer boundary line L14 interposed therebetween. An end edge of the first outer region 71 on an inner side thereof in the radial direction serves as a first outer boundary line L11. A central region Ac is formed further inward in the radial direction than the first outer boundary line L11.

The end edges on the downstream side of the first outer region 71, the second outer region 72, the third outer region 73, and the fourth outer region 74 are adjacent to the slit 5. The length of the slit 5 in the radial direction is smaller than that of the outer fine uneven region 61. Therefore, all of the first outer region 71, the second outer region 72, the third outer region 73, and the fourth outer region 74 are gradually curved from upstream toward downstream in the flowing direction to change toward a state of extending outward in the radial direction, thereby being connected to the slit 5. The second outer region 72 is more significantly curved than the first outer region 71. The third outer region 73 is more significantly curved than the second outer region 72. The fourth outer region 74 is more significantly curved than the third outer region 73. That is, the degree of curvature of the curved outer regions 7 increases inward in the radial direction.

The inner fine uneven region 62 is provided in a further inner position in the radial direction than the outer fine uneven region 61 with a central portion (central region Ac) on the pressure side 21P sandwiched therebetween. The inner fine uneven region 62 guides droplets attached to the pressure side 21P such that the droplets moving in the flowing direction are gradually moved inward in the radial direction. The inner fine uneven region 62 is divided into a plurality of (four) regions (inner regions 8) in the radial direction. The inner region 8 on the most outer side in the radial direction serves as a first inner region 81. A second inner region 82 is adjacent to the first inner region 81 on an outer side thereof in the radial direction with a second inner boundary line L22 interposed therebetween. A third inner region 83 is adjacent to the second inner region 82 on an inner side thereof in the radial direction with a third inner boundary line L23 interposed therebetween. A fourth inner region 84 is adjacent to the third inner region 83 on an inner side thereof in the radial direction with a fourth inner boundary line L24 interposed therebetween. An end edge of the first inner region 81 on an inner side thereof in the radial direction serves as a first inner boundary line L21. The central region Ac described above is formed further outward in the radial direction than the first inner boundary line L21.

The end edges on the most downstream side of the first inner region 81, the second inner region 82, the third inner region 83, and the fourth inner region 84 are adjacent to the trailing edge 21R with a gap V therebetween in the flowing direction. All of the first inner region 81, the second inner region 82, the third inner region 83, and the fourth inner region 84 are gradually curved from upstream toward downstream in the flowing direction to change toward a state of extending inward in the radial direction. The second inner region 82 is more significantly curved than the first inner region 81. The third inner region 83 is more significantly curved than the second inner region 82. The fourth inner region 84 is more significantly curved than the third inner region 83. That is, the degree of curvature of the curved inner regions 8 increases outward in the radial direction.

Figure 3:
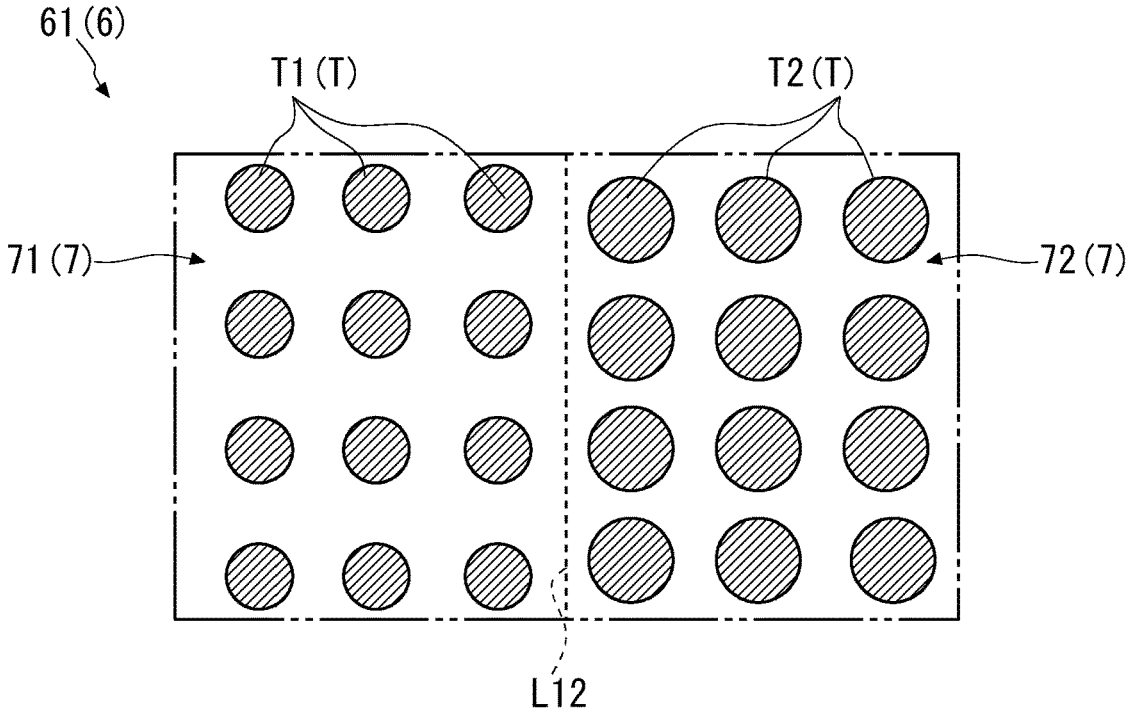
FIG. 3 is an enlarged view illustrating a constitution of a fine uneven region according to the first embodiment of the present invention.
Figure 4:
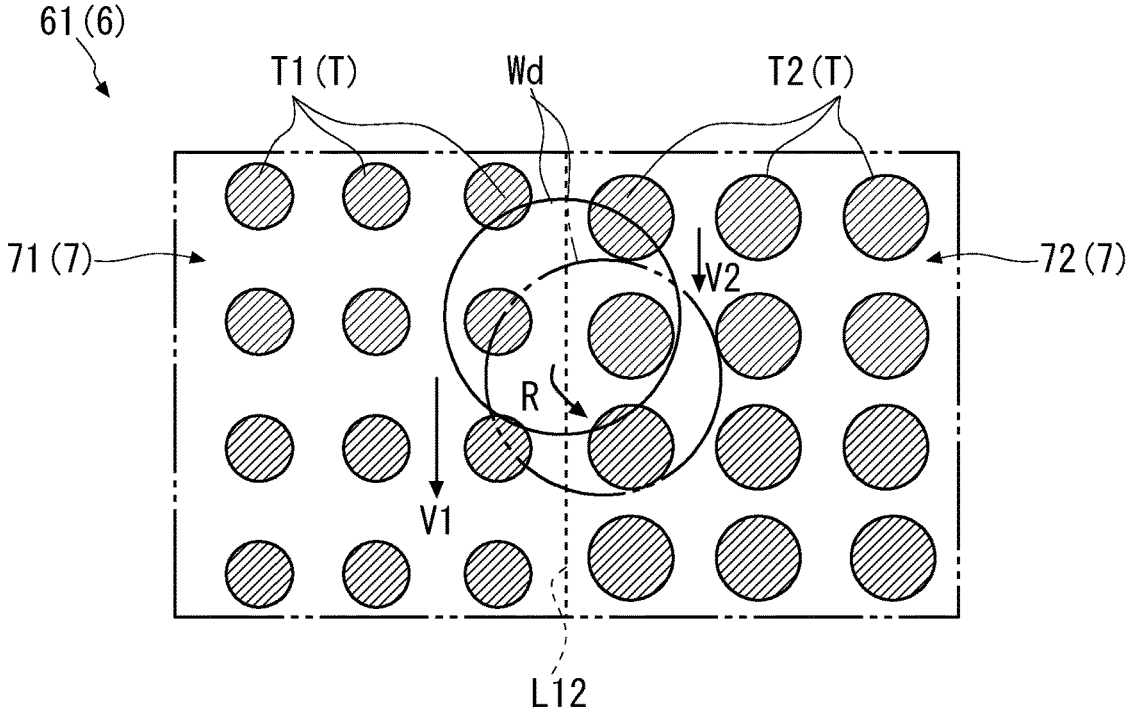
FIG. 4 is an explanatory diagram illustrating behavior of droplets in the fine uneven region according to the first embodiment of the present invention.

Both the outer fine uneven region 61 and the inner fine uneven region 62 are hydrophilic. Here, the aforementioned state "being hydrophilic" indicates a state in which a contact angle of droplets with respect to an adhesion surface is smaller than 90°, and a state in which the contact angle becomes smaller than 5° will be particularly referred to as super hydrophilicity. In addition, flow resistances to droplets differ from each other between the outer regions 7 and between the inner regions 8. More specifically, the flow resistance to droplets gradually becomes higher from the first outer region 71 toward the fourth outer region 74. Similarly, the flow resistance to droplets gradually becomes higher from the first inner region 81 toward the fourth inner region 84. Here, when the materials are the same, the flow resistance of a wall surface to a liquid film is determined depending on shapes, sizes, and disposition of the unevenness on the surface. Basically, the larger the area which comes into contact with a liquid surface is and the greater the degree to which the disposition directly blocks the flowing direction is, the higher the flow resistance is (moreover, when fine structures are disposed in the same manner, the more closely disposed the fine structures are, the higher hydrophilicity generally becomes, the larger the contact area with liquid is, and the higher the flow resistance is). Such a difference between the flow resistances is realized by the constitution illustrated in FIG. 3 or 4. FIGS. 3 and 4 representatively illustrate the first outer region 71 and the second outer region 72. However, a relationship between the second outer region 72 and the third outer region 73 and a relationship between the third outer region 73 and the fourth outer region 74 are also similar to the example in FIG. 3 or 4. In addition, the inner fine uneven region 62 also has a similar constitution.

FIG. 3 representatively illustrates an enlarged part in the vicinity of a boundary line (second outer boundary line L12) between the first outer region 71 and the second outer region 72 in the outer fine uneven region 61. As illustrated in the same diagram, in the first outer region 71 and the second outer region 72, a plurality of projecting portions T individually protruding in the circumferential direction from the pressure side 21P are arranged with an equal gap therebetween (at an equal pitch). Each of the projecting portions T has a circular cross section when viewed in the circumferential direction. The pitch of the projecting portions T formed in the second outer region 72 (second projecting portions T2) is greater than the pitch of the projecting portions T formed in the first outer region 71 (first projecting portions T1). In addition, the diameters of the second projecting portions T2 are greater than the diameters of the first projecting portions. Therefore, since the projecting portions T (first projecting portions T1) are disposed in a relatively "close" manner in the first outer region 71, the flow resistance to droplets in the first outer region 71 becomes higher than the flow resistance to droplets in the second outer region 72.

Here, as illustrated in FIG. 4, a case in which one droplet Wd is attached to the outer fine uneven region 61 in a manner of straddling the second outer boundary line L12 is considered. In this case, in part of the droplet Wd on the second outer region 72 side, the flow resistance is relatively great compared to part on the first outer region 71 side. Accordingly, a moving speed V2 at the part of the droplet Wd on the second outer region 72 side is reduced compared to a moving speed V1 at the part of the droplet Wd on the first outer region 71 side. As a result, as indicated by the two-dot dashed line and the arrow R in FIG. 4, the droplet Wd moves from an original position toward the second outer region 72 side while rotating. Such movement of droplets is caused due to only a difference between the flow resistances of two regions without depending on an external force such as a fluid force of steam.

Due to a driving force based on such a difference between the flow resistances, droplets attached to the outer fine uneven region 61 are gradually guided outward in the radial direction and from upstream toward downstream in the flowing direction. Thereafter, droplets flow into the slit 5 via the end edge on the downstream side. Similarly, droplets attached to the inner fine uneven region 62 are gradually guided inward in the radial direction and from upstream toward downstream in the flowing direction. Thereafter, droplets flow away to the downstream side of the stator blade main body 21 via the gap V.

As described above, according to the foregoing constitution, in the outer fine uneven region 61, the flow resistance to droplets gradually increases toward the slit 5. The higher the flow resistance to droplets is, the slower the flow rate of the droplets is. Namely, in droplets straddling two regions having different flow resistances, a speed component from the region having the lower flow resistance toward the region having the higher flow resistance is generated. Therefore, when the flow resistance increases toward the slit 5 as described above, droplets flow such that they are guided toward the slit 5. As a result, droplets positioned at a central portion on the pressure side 21P in the radial direction are guided to the outer fine uneven region 61 so that the droplets flow in the radial direction and then are captured by the slit 5. Accordingly, it is possible to reduce a possibility that split droplets will scatter downstream of the stator blade main body 21.

Moreover, according to the foregoing constitution, the outer fine uneven region 61 has a plurality of hydrophilic outer regions 7 which are provided to be adjacent to each other in the radial direction. Therefore, droplets spread more thinly based on the hydrophilicity of the hydrophilic outer region 7. Accordingly, droplets are likely to straddle between the foregoing plurality of outer regions 7. Therefore, in droplets straddling two outer regions 7 having different flow resistances, a speed component is generated from the region having the lower flow resistance toward the region having the higher flow resistance. As a result, droplets positioned at a central portion (central region Ac) on the pressure side 21P in the radial direction are guided to the outer fine uneven region 61 so that they flow toward the slit 5. Accordingly, it is possible to further reduce a possibility that droplets will split and scatter downstream.

Further, according to the foregoing constitution, the outer fine uneven region 61 is gradually curved from upstream toward downstream to change from a state of extending in the flow direction toward a state of extending in the radial direction. Therefore, droplets flowing in the flowing direction can be more actively guided such that the droplets are moved in the radial direction. Accordingly, it is possible to further reduce a possibility that split droplets will scatter downstream in the flowing direction.

Furthermore, according to the foregoing constitution, the flow resistance to droplets gradually increases inward in the radial direction in the inner fine uneven region 62. The higher the flow resistance to droplets is, the slower the flow rate of the droplets is. Namely, in droplets straddling two regions having different flow resistances, a speed component is generated from the region having the lower flow resistance toward the region having the higher flow resistance. Therefore, when the flow resistance increases in the radial direction as described above, droplets flow such that they are guided from outward to inward in the radial direction. As a result, droplets positioned at a central portion (central region Ac) on the pressure side 21P in the radial direction are guided to the inner fine uneven region 62 so that they flow inward in the radial direction. Since a peripheral speed of the rotor blade 30 is reduced inward in the radial direction, compared to a case in which droplets collide with a part positioned on the outside of the rotor blade 30 in the radial direction in which the peripheral speed is relatively high, it is possible to reduce a possibility that erosion or braking loss will occur.

Hereinabove, the first embodiment of the present invention has been described. The foregoing constitutions can be subjected to various changes and modifications within the scope of the present invention. For example, in the foregoing first embodiment, an example in which each of the outer fine uneven region 61 and the inner fine uneven region 62 is divided into four regions (the outer regions 7 and the inner regions 8) having different flow resistances has been described. However, the outer fine uneven region 61 and the inner fine uneven region 62 may be divided into three or fewer regions or may be divided into five or more regions based on a difference between the flow resistances.

In addition, a plurality of divided regions may be arranged as one group in a repeated form. According to this constitution, there is a difference between the flow resistances to droplets or liquid films of the hydrophilic regions, the regions on the unworked surface, and the water-repellent regions in this order. Generally, the more hydrophilic a wall surface is, the better the affinity between water and the wall surface becomes. Namely, forces of pulling each other between water and the wall surface become stronger. Consequently, the flow resistance increases. The higher the flow resistance to droplets or liquid films is, the slower the flow rate of the droplets is. Namely, in droplets straddling two regions having different flow resistances, a speed component is generated from the region having the lower flow resistance toward the region having the higher flow resistance. Therefore, droplets flow such that they are guided toward the slit. As a result, droplets positioned at a central portion on the pressure side in the radial direction are guided to the fine uneven region so that they flow in the radial direction and then are captured by the slit. Accordingly, it is possible to reduce a possibility that split droplets will scatter on the downstream side of the turbine stator blade and collide with the turbine rotor blade.

Moreover, an unworked surface may be formed between the regions. Here, the aforementioned "unworked surface" indicates a surface in a state in which fine unevenness described above is not formed. According to this constitution, the flow resistance increases from the water-repellent regions toward the hydrophilic regions. Basically, a liquid film flows along a flow of a surrounding air flow. However, if the flow resistances of portions of the wall surface differ from each other, a liquid film is curved to a portion where the flow resistance is high. Namely, a speed component is generated in a direction in which the flow resistance increases. Since a liquid film has a large inertial force because it is formed of liquid, the liquid film goes over the area of the highest flow resistance on a processed surface repeatedly arranged in the foregoing constitution and moves to the place of the next lower flow resistance, and this process is repeated. Therefore, droplets flow such that they are guided toward the slit. As a result, droplets positioned at a central portion on the pressure side in the radial direction are guided to the fine uneven region so that the droplets flow in the radial direction and then are captured by the slit. Accordingly, it is possible to reduce a possibility that split droplets will scatter downstream of the turbine stator blade and collide with the turbine rotor blade.

Moreover, in the foregoing first embodiment, an example in which only the outer fine uneven region 61 is adjacent to the slit 5 has been described. However, it is possible to employ a constitution in which the inner fine uneven region 62 is also adjacent to the slit 5, in addition to the outer fine uneven region 61. More specifically, it is possible to employ a constitution in which the slit 5 is disposed on the downstream side of the central region Ac on the pressure side 21P and the outer fine uneven region 61 and the inner fine uneven region 62 are individually curved and expand toward the slit 5. With a constitution in which the closer to the slit 5 the regions (the outer regions 7 and the inner regions 8) are, the greater the flow resistances to droplets thereof are, droplets can also be guided into the slit 5 from the inner fine uneven region 62 in addition to the outer fine uneven region 61.

Second Embodiment

Figure 5:
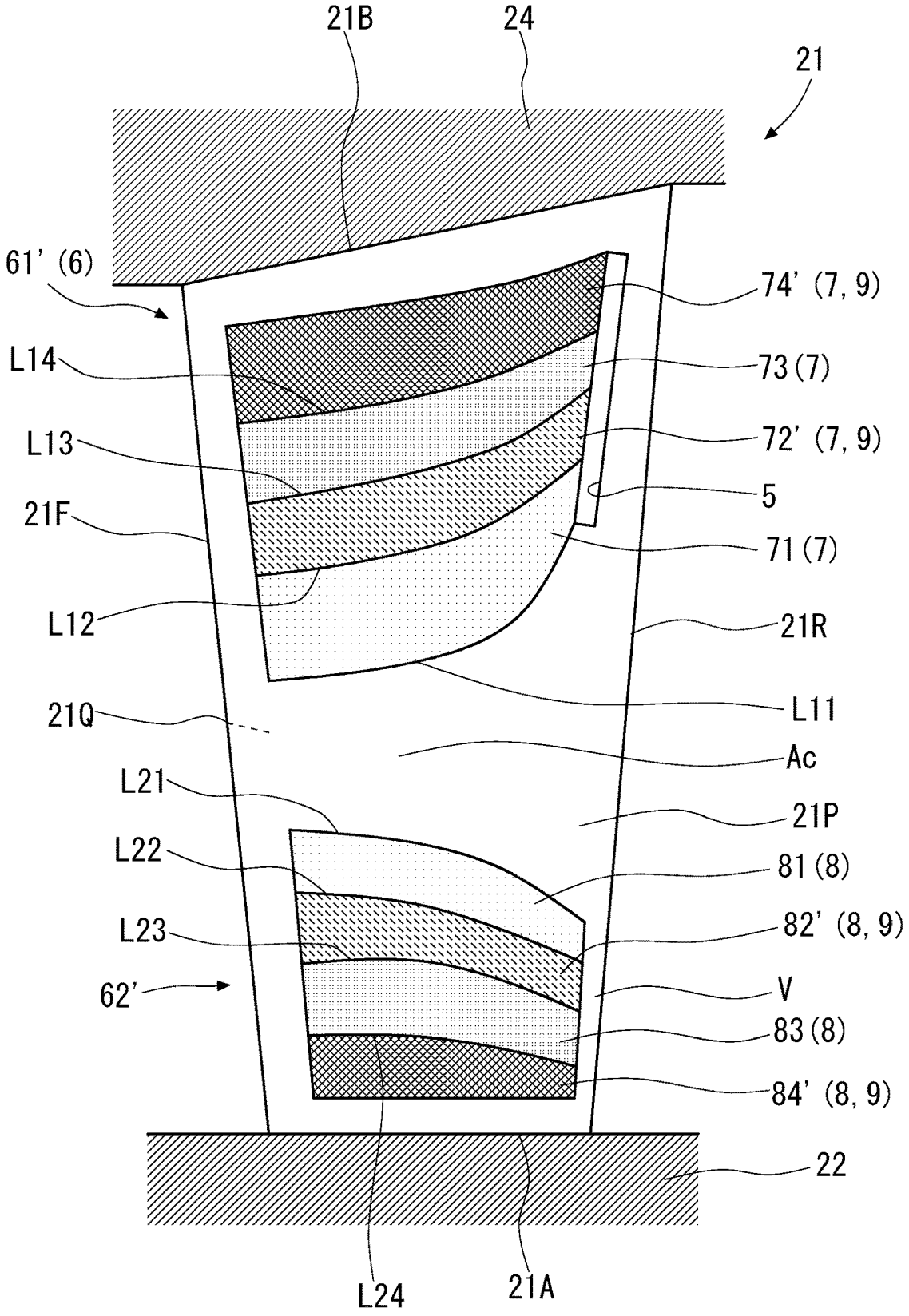
FIG. 5 is a side view illustrating a constitution of a turbine stator blade according to a second embodiment of the present invention.

Next, a second embodiment of the present invention will be described with reference to FIG. 5. The same reference signs are applied to constitutions similar to those of the foregoing first embodiment, and detailed description will be omitted. As illustrated in FIG. 5, in the present embodiment, constitutions of an outer fine uneven region 61' and an inner fine uneven region 62' are different from those of the first embodiment.

In the outer fine uneven region 61', the first outer region 71 and the third outer region 73 are hydrophilic similar to the first embodiment. On the other hand, a second outer region 72' and a fourth outer region 74' serve as water-repellent regions 9 having water-repellency. In the inner fine uneven region 62', the first inner region 81 and the third inner region 83 are hydrophilic similar to the first embodiment. On the other hand, a second inner region 82' and a fourth inner region 84' serve as the water-repellent regions 9 having water-repellency. Here, the aforementioned state "being water-repellent" indicates a state in which a contact angle of droplets attached to the water-repellent regions 9 is 90° or larger. Particularly, a case in which the contact angle thereof is 150° or larger will be referred to as a super water-repellent state. Namely, in the outer fine uneven region 61' and the inner fine uneven region 62', hydrophilic regions and water-repellent regions are alternately arranged in the radial direction.

According to the foregoing constitution, there is a difference between the flow resistances to droplets of the hydrophilic regions and the water-repellent regions. The greater the flow resistance to droplets is, the slower the flow rate of the droplets is. Namely, in droplets straddling two regions having different flow resistances, a speed component is generated from the region having the lower flow resistance toward the region having the higher flow resistance. Therefore, droplets flow such that they are guided toward the slit 5 or the gap V described above. As a result, droplets positioned at a central portion (central region Ac) on the pressure side 21P in the radial direction are guided to the outer fine uneven region 61' and the inner fine uneven region 62' so that they flow in the radial direction. Accordingly, it is possible to reduce a possibility that split droplets will scatter on the downstream side of the stator blade main body 21.

Hereinabove, the second embodiment of the present invention has been described. The foregoing constitutions can be subjected to various changes and modifications within the scope of the present invention. For example, a constitution which has been described as a modification example of the foregoing first embodiment can also be applied to the present embodiment.

Third Embodiment

Figure 6:
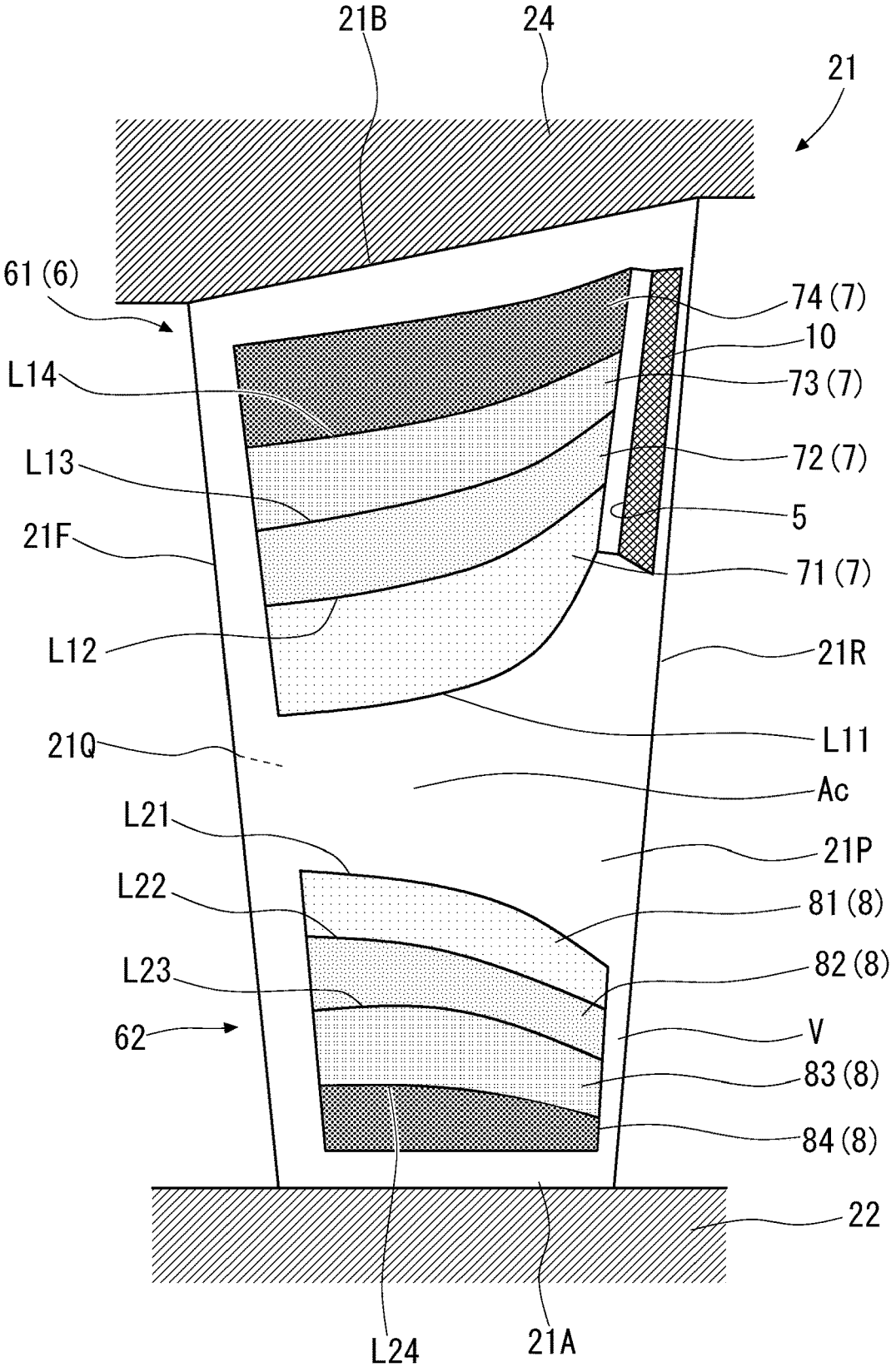
FIG. 6 is a side view illustrating a constitution of a turbine stator blade according to a third embodiment of the present invention.

Subsequently, a third embodiment of the present invention will be described with reference to FIG. 6. The same reference signs are applied to constitutions similar to those of each of the foregoing embodiments, and detailed description will be omitted. As illustrated in FIG. 6, in the present embodiment, a super water-repellent region 10 having higher water-repellency (super water-repellency) than the pressure side 21P is formed in the gap V between the slit 5 and the trailing edge 21R. Here, the aforementioned state "having super water-repellency" indicates a state in which a contact angle of droplets attached to the super water-repellent region 10 is 150° or larger. The super water-repellent region 10 expands on the downstream side (toward trailing edge 21R side) adjacent to the end edge of the slit 5 on the downstream side thereof.

According to the foregoing constitution, the super water-repellent region 10 is formed in the gap V between the slit 5 and the trailing edge 21R. Accordingly, for example, even when some droplets cannot be captured enough by the slit 5 and flow away to the downstream side, they are repelled by the super water-repellent region 10. Therefore, it is possible to reduce a possibility that droplets will remain on the downstream side of the slit 5 (gap V). As a result, it is possible to suppress a situation in which the remaining droplets gather and a larger liquid film is formed.

Hereinabove, the third embodiment of the present invention has been described. The foregoing constitutions can be subjected to various changes and modifications within the scope of the present invention. For example, regarding matters common to each of the embodiments described above, the disposition and the constitution of the projecting portions T in the fine uneven region 6 can be changed as follows. In the fine uneven region 6, the flow resistance may be varied by varying the sizes of the projecting portions T themselves toward outward from inward in the radial direction while having the same pitch (gap) between the projecting portions T. In addition, the flow resistance may be varied by disposing the projecting portions T in a lattice shape in one region and disposing the projecting portions T in a zigzag shape in another region. Moreover, the flow resistance may be varied by forming a linear groove extending in a predetermined direction in one region and forming a linear groove extending in a direction orthogonal to the predetermined direction in another region. Further, there may be a difference between the flow resistances by varying the density of the projecting portions T between one region and another region.

INDUSTRIAL APPLICABILITY

The present invention can be applied to a turbine stator blade and a steam turbine.

REFERENCE SIGNS LIST

100 Steam turbine
1 Rotary shaft
2 Steam turbine casing
3 Steam turbine rotor
4A Journal bearing
4B Thrust bearing
5 Slit
6 Fine uneven region
7 Outer region
8 Inner region
9 Water-repellent region
10 Super water-repellent region
11 Shaft end
12 Steam supply pipe
13 Steam exhaust duct
20 Stator blade
21 Stator blade main body
21A Inner circumferential side end surface
21B Outer circumferential side end surface
21F Leading edge
21P Pressure side
21Q Suction side
21R Trailing edge
22 Stator blade shroud
30 Rotor blade
31 Rotor blade main body
34 Rotor blade shroud
61 Outer fine uneven region
62 Inner fine uneven region
71 First outer region
72, 72' Second outer region
73 Third outer region
74, 74' Fourth outer region
81 First inner region
82, 82' Second inner region
83 Third inner region
84, 84' Fourth inner region
L11 First outer boundary line
L12 Second outer boundary line
L13 Third outer boundary line
L14 Fourth outer boundary line
L21 First inner boundary line
L22 Second inner boundary line
L23 Third inner boundary line
L24 Fourth inner boundary line
O Axis
S Steam
T Projecting portion
T1 First projecting portion
T2 Second projecting portion
Wd Droplet

The invention claimed is:

1. A turbine stator blade comprising:

a pressure side extending in a radial direction intersecting a flowing direction of steam and facing upstream in the flowing direction, wherein a slit capturing droplets generated by liquefaction of the steam is formed on a downstream side of the pressure side, wherein a fine uneven region, which guides the droplets attached to the pressure side in the radial direction such that the droplets are moved toward the slit and from upstream toward downstream, is formed in a further upstream position than the slit, and wherein the fine uneven region has a flow resistance to the droplets gradually increasing from inward to outward in the radial direction.

2. The turbine stator blade according to claim 1, wherein the fine uneven region includes a plurality of hydrophilic regions which are provided to be adjacent to each other in the radial direction, flow resistances to the droplets of the plurality of hydrophilic regions are different from each other between the plurality of regions, and the further outward the hydrophilic region is positioned in the radial direction, the higher the flow resistance of the hydrophilic region is.

3. The turbine stator blade according to claim 1, wherein the fine uneven region is gradually curved from upstream toward downstream to change from a state of extending in the flow direction toward a state of extending in the radial direction.

4. The turbine stator blade according to claim 1, wherein the fine uneven region includes hydrophilic regions and water-repellent regions which are alternately arranged in the radial direction.

5. The turbine stator blade according to claim 1, wherein the slit is provided to be apart from a trailing edge that is an end edge of the turbine stator blade on the downstream side with a gap therebetween in the flowing direction, and a super water-repellent region having higher water repellency than the pressure side is formed in the gap.

6. The turbine stator blade according to claim 1, wherein an inner fine uneven region guiding the droplets attached to the pressure side in the radial direction from upstream toward downstream is further formed on an inner side in the radial direction of the fine uneven region of the pressure side, and wherein the inner fine uneven region has a flow resistance to the droplets gradually increasing inward in the radial direction.

7. The turbine stator blade according to claim 1, wherein the fine uneven region includes a hydrophilic region and a water-repellent region arranged in the radial direction and an unworked surface formed between the hydrophilic region and the water-repellent region.

8. The turbine stator blade according to claim 1, wherein the fine uneven region includes a hydrophilic region and a water-repellent region arranged in the radial direction and an unworked surface formed between the hydrophilic region and the water-repellent region; and the hydrophilic region, the unworked surface and the water-repellent region are arranged in this order and in a repeated form.

9. A steam turbine comprising:

a rotary shaft rotatable around an axis;

a plurality of turbine rotor blades arranged in a circumferential direction with respect to an axis direction on an outer circumferential surface of the rotary shaft;

a casing covering the rotary shaft and the turbine rotor blades from an outer circumferential side; and a plurality of the turbine stator blades according to claim 1 arranged in the circumferential direction around the axis on an inner circumferential surface of the casing and provided to be adjacent to the turbine rotor blades in the axis direction.

* * * * *